US010231493B1

(12) United States Patent
Sarantos

(10) Patent No.: US 10,231,493 B1
(45) Date of Patent: Mar. 19, 2019

(54) MODULAR VEST SYSTEM

(71) Applicant: George Sarantos, Naples, FL (US)

(72) Inventor: George Sarantos, Naples, FL (US)

( * ) Notice: Subject to any disclaimer, the term of this patent is extended or adjusted under 35 U.S.C. 154(b) by 299 days.

(21) Appl. No.: 14/943,274

(22) Filed: Nov. 17, 2015

Related U.S. Application Data

(60) Provisional application No. 62/080,787, filed on Nov. 17, 2014.

(51) Int. Cl.
*A41D 1/04* (2006.01)
*A41D 27/20* (2006.01)

(52) U.S. Cl.
CPC ..... *A41D 1/04* (2013.01); *A41D 27/20* (2013.01)

(58) Field of Classification Search
CPC ..... A41D 1/04; A41D 27/20; A41D 13/0012; A41D 13/0007; A45F 3/04; A45F 3/02; A45F 3/047; A45F 3/14; A45F 2003/025; A45F 2003/146; A45F 2003/148; A45F 2003/142; A45F 2003/045; A62B 35/0006; A62B 35/0025; A62B 35/0018; A62B 35/00; A45C 15/00
USPC ..... 2/102, 103, 94, 95, 127, 139; 224/647, 224/582, 153, 576
See application file for complete search history.

(56) References Cited

U.S. PATENT DOCUMENTS 1,849,628 A * 3/1932 Lemercier ..... B64D 17/30 2/69
2,760,699 A * 8/1956 Rivers-MacPherson ..... A45F 3/04 224/201
4,106,121 A * 8/1978 Belson ..... A41D 13/0012 2/102
4,600,134 A * 7/1986 Colby ..... A45F 3/04 224/260
4,793,534 A * 12/1988 Berry ..... A45F 3/02 224/223
D316,172 S * 4/1991 Hanson ..... D2/829
5,014,359 A * 5/1991 Hanson ..... A41D 13/0012 2/102
5,020,941 A * 6/1991 Bulin ..... B63C 11/04 405/186
5,129,560 A * 7/1992 Herman ..... A45F 3/00 224/153
5,249,890 A * 10/1993 Bergstrom ..... B63C 11/02 405/185

(Continued)

*Primary Examiner* — Anna K Kinsaul
*Assistant Examiner* — F Griffin Hall
(74) *Attorney, Agent, or Firm* — McHale & Slavin, P.A.

(57) ABSTRACT

A modular utility vest system comprised of a harness portion and at least one frontal vest portion, the modular vest being constructed and arranged for independent use or removable engagement with an existing backpack. The harness portion includes a top element having an open slit for slidable engagement with a top handle on an existing backpack and two shoulder straps extending from opposing ends of the top element, each strap having adjustable buckling elements. The vest portion is comprised of a top end having a second buckling element and at least one pocket attached thereto. In use, the harness portion is positioned overtop of an existing backpack top handle, whereby the two shoulder straps on the harness portion lay overtop and are coupled to the shoulder straps on the existing backpack and the cooperating buckling elements on the vest portion are attached to the harness portion and depends vertically therefrom.

14 Claims, 9 Drawing Sheets

(56) References Cited

U.S. PATENT DOCUMENTS 5,337,934 A * 8/1994 Johnson ..... A41D 13/0012 224/148.5
D352,165 S * 11/1994 Covertson ..... 2/102
5,361,412 A * 11/1994 Perry ..... A41D 13/0012 2/102
5,497,922 A * 3/1996 Tate ..... A45F 3/04 224/160
5,603,441 A * 2/1997 Easter ..... A45F 3/00 224/153
5,634,579 A * 6/1997 Baclawski ..... A45F 3/04 2/102
5,639,005 A * 6/1997 Chouinard ..... A41D 15/04 224/580
5,657,917 A * 8/1997 Johnson ..... A45F 3/04 224/153
5,799,851 A * 9/1998 Wulf ..... A45C 7/0045 224/580
5,803,667 A * 9/1998 Seligman ..... B63C 11/30 2/102
5,893,502 A * 4/1999 Redzisz ..... A01K 97/00 190/1
5,909,802 A * 6/1999 Puco ..... A45F 3/04 2/102
5,988,475 A * 11/1999 Han ..... A45F 3/04 224/608
D418,673 S * 1/2000 Madsen ..... D2/830
6,095,389 A * 8/2000 Fenton ..... A45F 3/04 224/259
6,336,222 B1 * 1/2002 Ware ..... A41D 3/00 2/102
6,419,132 B1 * 7/2002 Reed ..... A45C 15/00 109/49.5
6,662,984 B2 * 12/2003 Mor ..... A45F 3/04 224/266
6,772,925 B2 * 8/2004 O'Hare ..... A45F 3/08 2/102
6,923,357 B2 * 8/2005 Smith ..... A01K 97/06 224/251
7,681,769 B2 3/2010 Kramer
D641,960 S * 7/2011 Goff ..... D2/829
8,042,196 B1 * 10/2011 Kirby ..... A41D 3/08 2/102
8,567,652 B2 * 10/2013 Di Stasio ..... A45F 3/047 224/578
9,022,269 B1 * 5/2015 Woodcock ..... A45F 4/00 224/576
9,826,816 B1 * 11/2017 Chang ..... A45F 3/08
9,901,162 B1 * 2/2018 Chang ..... A45F 3/047
9,949,557 B2 * 4/2018 Crimaldi ..... A45F 3/10
2001/0025867 A1 * 10/2001 Chuang ..... A45F 3/04 224/627
2005/0005343 A1 * 1/2005 Johnson ..... F41H 1/02 2/102
2006/0138188 A1 * 6/2006 Kramer ..... A45F 3/08 224/581
2006/0226183 A1 * 10/2006 Sanderson ..... A45F 3/00 224/201
2007/0187444 A1 * 8/2007 Hajari ..... A01M 31/02 224/155
2007/0295774 A1 * 12/2007 Matschke ..... A01K 97/06 224/581
2009/0031467 A1 * 2/2009 Swindells ..... A41D 13/0012 2/51
2009/0294500 A1 * 12/2009 Brown ..... A45F 3/04 224/651
2010/0282803 A1 * 11/2010 Simmons ..... A41D 13/0007 224/576
2011/0180579 A1 * 7/2011 Richardson ..... A41D 13/0012 224/657
2012/0018477 A1 * 1/2012 Inouye ..... A45F 3/06 224/576
2012/0152991 A1 * 6/2012 Roane ..... A45C 7/0086 224/259
2014/0048575 A1 * 2/2014 Kennedy-Sharpe ..... A45C 3/00 224/637
2014/0203057 A1 * 7/2014 Goryl ..... A41D 13/0012 224/576
2014/0239030 A1 * 8/2014 Roth ..... A45F 3/10 224/633
2014/0367428 A1 * 12/2014 Khatib ..... A45F 3/04 224/260
2014/0374450 A1 * 12/2014 Kruse ..... A45F 4/02 224/153
2015/0201761 A1 * 7/2015 Wollenberg ..... A47D 13/025 224/576
2015/0313346 A1 * 11/2015 Doubleday ..... A45F 3/04 224/627
2016/0081460 A1 * 3/2016 Di Stasio ..... A45F 3/047 224/153
2016/0128394 A1 * 5/2016 Kohrman ..... A45F 3/14 2/102
2017/0112266 A1 * 4/2017 Constanzo ..... A45F 3/14
2017/0182652 A1 * 6/2017 Martinez ..... B25H 3/022
2017/0231370 A1 * 8/2017 Crimaldi ..... A45F 3/10 224/637
2017/0238682 A1 * 8/2017 Goryl ..... A45F 3/047
2017/0258207 A1 * 9/2017 Blanton ..... A42B 1/041
2017/0295913 A1 * 10/2017 Gaskin ..... A45F 4/02
2017/0303669 A1 * 10/2017 O'Neil ..... A45F 3/04
2017/0332768 A1 * 11/2017 Fraile Nuez ..... A45F 3/06
2018/0055198 A1 * 3/2018 Chang ..... A45F 3/047
2018/0070706 A1 * 3/2018 Hanssen ..... A45F 3/047

* cited by examiner

MODULAR VEST SYSTEM

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 62/080,787, entitled "MODULAR VEST SYSTEM", filed Nov. 17, 2014. The contents of which the above referenced application is incorporated herein by reference.

FIELD OF THE INVENTION

The present invention relates generally to a device for carrying articles. More particularly, the instant invention is directed to a modular vest system for carrying articles constructed and arranged for independent use or in conjunction with, and by attachment to, an existing backpack wherein said articles can be accessed without removing the backpack from the wearer's body.

BACKGROUND OF THE INVENTION

Over the years, numerous types, sizes, and styles of devices designed to assist one in carrying articles such as backpacks, vests, and other devices to be worn by an individual have been made or proposed for conveniently carrying and storing various articles such as clothing, books, camping gear, hunting gear, sports gear, baby items, or the like. For example, a typical backpack (also referred to as a rucksack, knapsack, packsack, pack or Bergen) consists of a sack with two straps, whereby one strap loops over each shoulder of the wearer. Backpacks have been particularly useful in carrying and storing various articles because they free the hands of the wearer for other activities. Backpacks have become increasingly popular over the years, especially for travel and recreational activities. When a backpack is worn, the wearer can carry a heavy load without putting undue burden on their arms, thus freeing their hands for other tasks. However, wearers have always had to deal with the inconvenience of removing the carrying device when they seek to gain access to articles stored within the sack.

It has become common for travelers to utilize a backpack, wherein personal belongings may be carried on one's back in a cloth sack that is slung over one's shoulders by means of shoulder straps. However, the inconvenience of a backpack type sack is that its wearer is denied access to personal papers such as tickets, passports, or travelers checks while the backpack is being worn. Some carrying device designers have attempted to minimize this problem by attaching smaller pockets to the front straps of the backpack. However, since the size of the pocket is limited to the size of the strap to which it is attached and to the size of the wearer's chest, this solution provides easy access to only a limited amount of space. Consequently, there is a need for a larger pouch that can be easily accessed from the front of the body. Experienced travelers using backpacks have resorted to a simpler measure, such as carrying a daypack to accompany the backpack. This daypack, which is smaller than the backpack and which includes its own shoulder straps, is slung over one's shoulder in a reverse manner so that the daypack rides against the chest of the wearer while the backpack rides against the back. The daypack allows the traveler to access personal papers being carried therein, such as tickets, passports, money, or the like. U.S. Pat. No. 5,799,851 discloses a combination daypack and backpack that has a detachable daypack that may be worn on the front of the user in conjunction with a larger conventional backpack. The daypack is directly affixed to D-rings mounted on the shoulder straps of the backpack and positioned adjacent to the user's chest. However, this combination daypack and backpack is only suitable for use with a particular backpack having D-rings located in a specific position on its shoulder straps. It is well known that individuals often own numerous backpacks suitable for various needs such as travel or sports activities, but the above patent does not allow for versatility in using various backpacks that one may own as it limits use just to the particular backpack having D-rings on its shoulder straps.

Backpacks are particularly convenient for a wide range of activities such as fishing, walking, hiking, climbing, biking, camping, skiing, snowboarding, snowshoeing, mountaineering, rock-climbing, hunting, and the like because they free the hands of the user and transfer the load away from the wearer's hands, which can be easily fatigued if one were to hand carry articles. Conventional backpacks are typically designed to be worn with the carrying sack on the user's back. Therefore, to gain access to articles contained in the pack, the user must first remove the pack, creating a number of inconveniences for almost any type of activity. Once the pack is removed, at least one hand is required to hold it, leaving only the other hand to open or unzip the pack, access the desired article contained therein, and then juggle the article while zipping or buckling the pack cover in place. Alternatively, the pack may be placed on a stable surface, such as a table or the ground, to free up a hand to retrieve the article contained within. Should the article be needed in a hurry, such as in the case of an emergency, the time taken removing, holding, unzipping, and accessing could prove to be a detriment. Therefore, numerous vests designed for carrying articles in a front loaded pack where the articles can be accessed without requiring the wearer to remove the pack have been introduced.

Fisherman, hunters, backpackers, hikers, soldiers, construction workers and loggers are in the outdoors a considerable amount of the time. Often, there is a need for a garment for carrying and accessing items immediately, and a vest proves to be a suitable, handy, and expedient solution. For example, a fisherman may want fish hooks, a fish line, dry socks, a knife, matches, a compass and some food. More particularly, a person who engages in fly-fishing may wear a front utility vest that includes a wool patch where fishing hooks may be attached, as well as several pockets for carrying fishing equipment. To provide such flexibility, it would be desirable to have a utility vest that could easily be worn with a backpack or without the backpack. Other instances where one may require the use of a front vest include: a hunter who may want easy access to ammunition, a knife, matches, dry socks, a compass, or food; a hiker who may want food, large blankets, alternative rain gear, matches, a compass, or a knife; a soldier who may want a knife, ammunition, hand grenades, matches, food, a compass, dry clothing, and maybe a mobile communication device; and a construction worker who may want a garment having facilities for carrying tools. Unfortunately, the use of a vest often requires the user to purchase a backpack in order to get the vest. Additionally, some vests may be sold separately but are not compatible with any backpack because they do not attach to the shoulder harness thereof. Thus, the user runs the risk of purchasing a vest that may not be connectable to any of the backpacks one already owns.

U.S. Pat. Nos. 5,337,934 and 5,657,917 attempted to address these issues by providing a carrying device having pouches that can be flipped from a stowed position on a backpack over the wearer's shoulders to a position on the front of the wearer. In the above patents, the pouch is retained in the rear position by hook-and-loop material. While the aforementioned patents disclose a device that does allow the user to access some of the contents of the backpack without removing the pack, the hook-and-loop material has two noticeable deficiencies: 1) it is inadequate for retaining the pouches in their stowed position during physical activity, and 2) it is inadequate for retaining larger compartments capable of holding bulky or heavy articles. Because release of the hook-and-loop material is facilitated by loading the opposing sections in opposite directions to affect separation, a hook-and-loop fastener is susceptible to unwanted release due to dynamic shifting that naturally occurs during typical wearer's activity. Therefore, the aforementioned devices are not suitable when the wearer is engaged in physical activity, and especially when the wearer needs to have ease of access to a large compartment carrying much or all of the backpack's contents.

U.S. Pat. No. 5,639,005 also attempted to address the numerous disadvantages disclosed. The above patent describes a modular backpack and utility vest system wherein the backpack and the utility vest may each be used independently or together as a unit. The front portion of the utility vest further includes a pair of buckles at the top of the vest near the shoulders of a wearer and a buckle on either side of the vest near the waist of a wearer. A backpack designed specifically for use with the front portion of the utility vest has complementary buckles on the tops of the shoulder straps into which the top buckles on the utility vest front portion can be attached. The backpack further includes complementary buckles on the lower sides of the backpack for attaching the side buckles on the utility vest front portion. Although this patent addresses some of the needs discussed, it requires the user to purchase an entirely new set of a backpack and vest combination. This can be quite expensive considering that the user is most likely to already have several backpacks in his/her collection. Thus, what is lacking in the art is a modular vest that can be easily and securely attached to almost any existing backpack.

Thus, what is needed in the art is a modular vest system comprised of a harness portion and at least one frontal vest portion, whereby the modular vest system is constructed and arranged for removable engagement with an existing backpack. The modular vest should function with pre-existing backpacks and as a singular independent unit. The modular vest system should not be overly burdensome to carry, and should be operable and connectable with normal strength.

SUMMARY OF THE INVENTION

The present device relates to carrying packs, and more particularly to a modular vest system including a harness portion and at least one frontal vest portion. The modular vest system is constructed and arranged for independent use as well as removable engagement with an existing backpack. The harness portion is comprised of a top element, which can include an open slit for slidable engagement with the top handle on an existing backpack and two shoulder straps extending from opposing ends of the top element, each strap having adjustable buckling elements. The pair of shoulder straps form an opening sized to accommodate the head of a wearer. The frontal vest portion is comprised of a top end and at least one pocket attached thereto for storing articles. On the top end of the frontal vest is a second buckling element, whereby the cooperating buckling elements on the front vest portion and harness portion can be attached and the frontal vest portion depends vertically from the harness portion. When in use, the harness portion is positioned overtop of an existing backpack top handle and the two shoulder straps on the harness portion lay overtop of the existing backpack shoulder straps having the frontal vest portions coupled to the harness portion and depending downwardly therefrom.

Accordingly, it is an objective of the instant invention to provide a modular vest system that works as a unitary system with an existing backpack or independently without the use of a backpack.

It is a further objective of the instant invention to provide a modular vest system that is compatible with existing backpacks.

It is yet another objective of the instant invention to provide a modular vest system that is adjustable to various sizes to accommodate any wearer regardless of personal body size.

It is still further an objective of the invention to provide a modular vest that allows a user easy access to articles held in at least one pocket located on the front of the vest.

It is yet another objective of the instant invention to provide a modular vest constructed of a moisture resistant material so as to preclude the passage of moisture therethrough without prohibiting adequate airflow for ventilation.

A further objective of the instant invention is to provide a modular vest system that includes a pair of frontal vest portions connectable to the left and right buckling elements on the harness portion, wherein the buckling elements are fitted with quick-release type fasteners engageable with corresponding quick-release type fasteners on the vest portion.

Another objective of the instant invention is to provide a movable frontal vest portion that can be positioned across the front of a user by attachment of the top end of the vest to the left buckling element on the harness portion and attachment of the bottom end of the vest to the right bottom portion of the existing backpack shoulder strap.

Yet another objective of the instant invention is to provide a cushioned pad on the interior lining of the frontal vest portion for the comfort of the user.

It is another objective of the instant invention to provide a left and right waist connector coupled to the frontal vest portion. The connectors include adjustable straps so that the utility vest can be worn by people with different waist sizes and of different heights. Furthermore, the waist connector prevents "flopping" of the vest and inhibits unwanted motion when the user is engaged in an activity such as running or jumping.

It is another objective of the instant invention to provide a connector along the interior edge of a right frontal vest portion that can be connected to a corresponding connector along the interior edge of a left frontal vest. The connector enables the user to wear the frontal vests connected or separated depending upon the activity engaged in.

It is another objective of the instant invention to provide a frontal vest portion having at least one pocket which may be compressed, taking up only limited space, or expanded to hold substantial amounts of articles or materials.

It is another objective of the instant invention to provide a frontal vest portion that may include detachable pockets that are secured to the vest with hook-and-loop fasteners. While wearing the vest, the user can detach the pockets for whatever purpose desired and then easily reattach when the task is completed.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
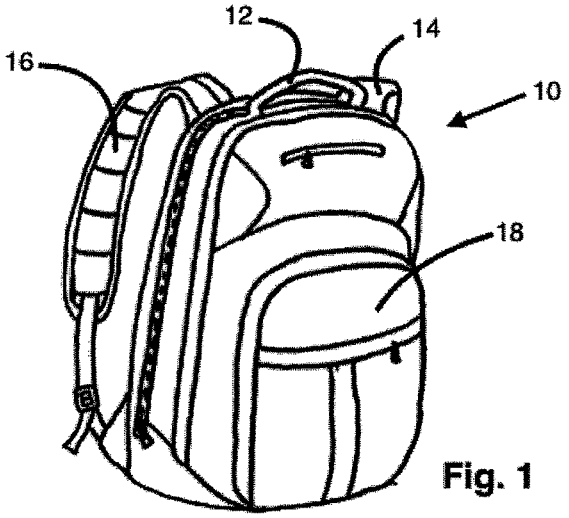
FIG. 1 is a perspective view of an existing backpack.
Figure 2:
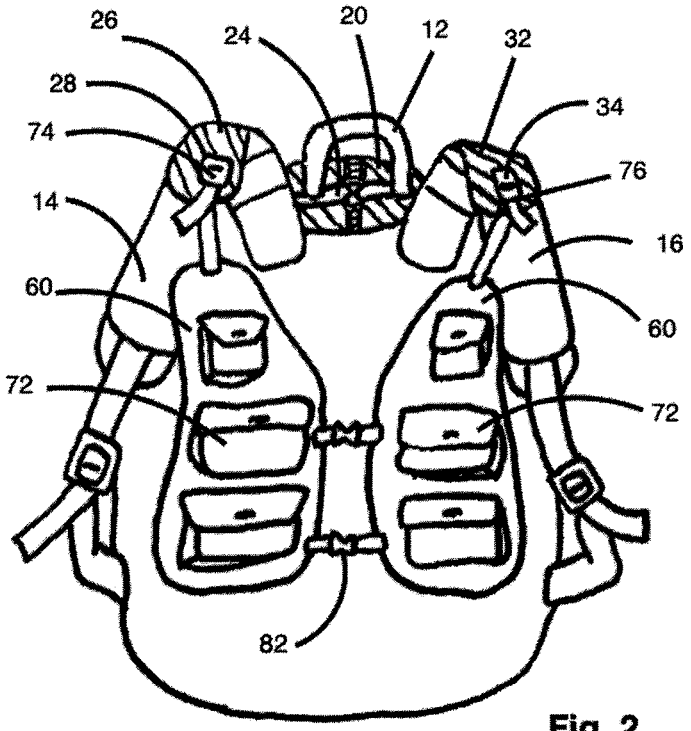
FIG. 2 is a front view of the present invention on an existing backpack.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring now to FIG. 1, set forth is an existing backpack 10. The backpack 10 is comprised of a cloth pack 18 for containing articles therein, a right shoulder strap 14, a left shoulder strap 16, and a top handle 12. The right shoulder strap 14 is placed overtop the right shoulder of the wearer, just as the left shoulder strap 16 is placed overtop the left shoulder of the wearer, thereby positioning the pack 18 on the back of the wearer. Positioning of the backpack 10 on the wearer frees one's hands for whatever purpose and provides an easy way to carry a heavy load without putting an undue burden on one's arms. The top handle 12 provides a means for the user to hand carry the backpack 10 when necessary, or to hold the backpack 10 with one hand while the other hand is used to access articles within the pack 18. The top handle 12 is typically situated on the top portion of the backpack 10 with each terminating end attached thereto and defines an opening for one's hand for carrying.

Figure 9:
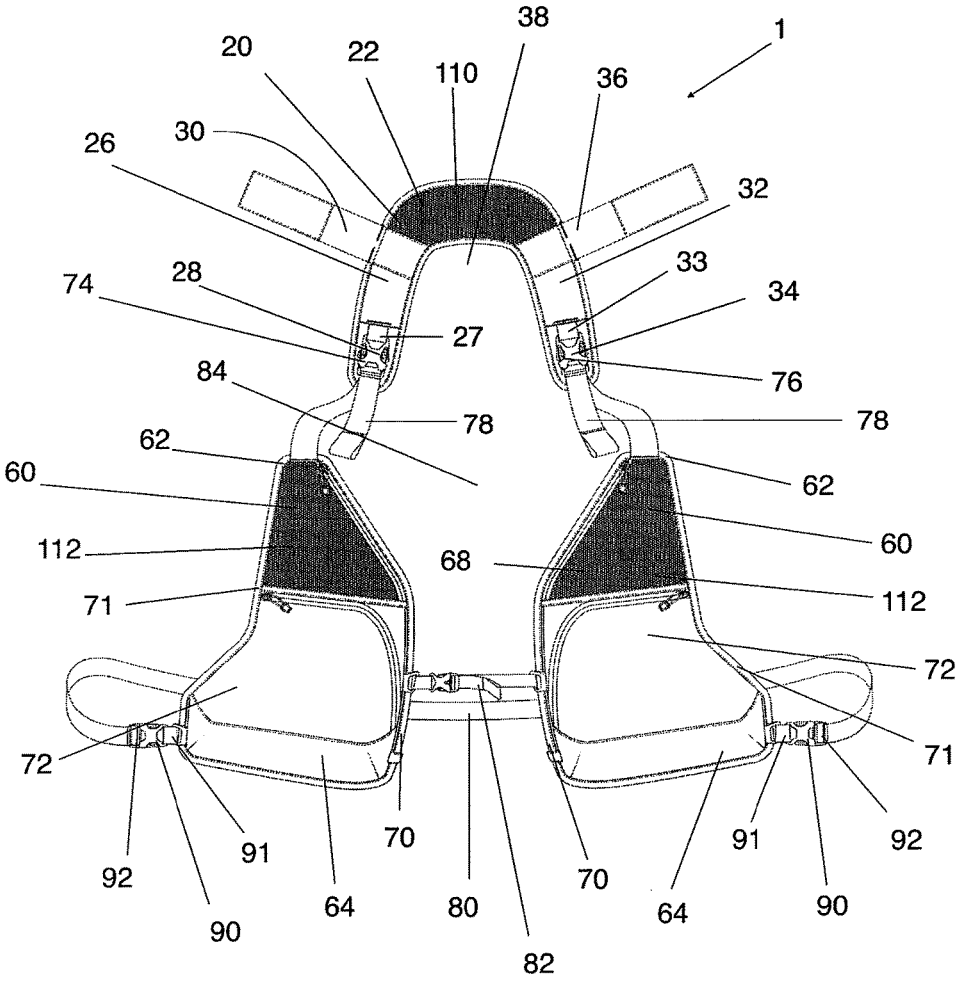
FIG. 9 is a front view of the present invention without an existing backpack attached thereto.
Figure 10:
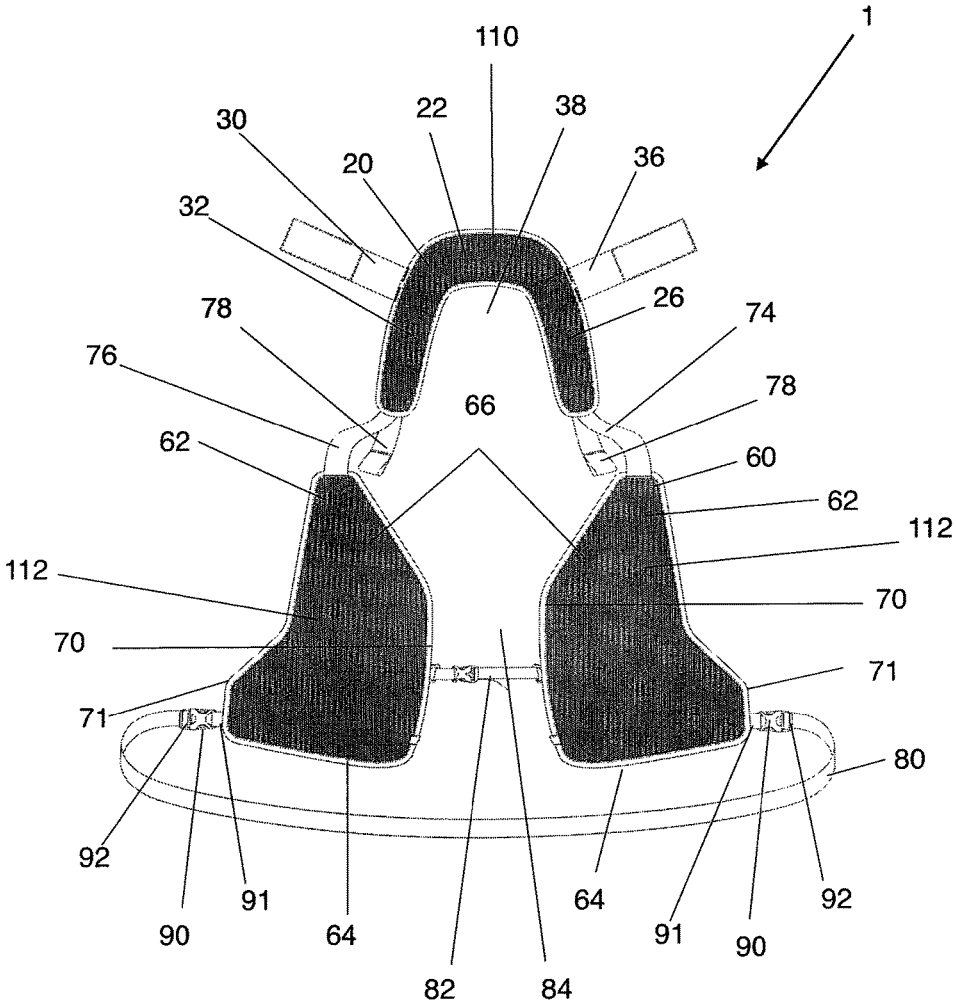
FIG. 10 is a back view of the present invention without an existing backpack attached thereto.

As shown in FIGS. 2-3 and 9-10, set forth is a modular vest system 1 (or vest) comprised of a harness portion 20 and at least one frontal vest portion 60 constructed and arranged for independent use or removable engagement with an existing backpack 10. The modular vest system 1 is constructed of a moisture resistant material, such as treated cloth or polymer, so as to preclude the passage of moisture therethrough without prohibiting adequate airflow for ventilation. As shown in FIGS. 9 and 10, the modular vest 1 need not be used in combination with an existing backpack. The modular vest 1 is contemplated for use by itself. The harness portion 20 includes a top element 22 having an open slit 24, shown in FIGS. 2 and 3, for slidable engagement with a top handle 12 on an existing backpack 10 and two shoulder straps, specifically a right harness shoulder strap 26 and a left harness shoulder strap 32, extending from opposing ends of the top element 22. Each shoulder strap 26 and 32 includes an adjustable buckling element 28 and 34. The pair of shoulder straps 26 and 32 form an opening 38 sized to accommodate the head of a user. In the preferred embodiment, the modular vest system 1 includes a pair of frontal vest portions 60. Each frontal vest portion 60 is comprised of a top end 62 and at least one pocket 72 for storing articles. On the top end 62 of each frontal vest 60 is a second buckling element 74 and 76 that corresponds to the buckling element 28 and 34 on the harness portion 20. In use, the harness portion 20 is positioned over the top of an existing backpack top handle 12 and the two harness shoulder straps 26 and 32 lay overtop of the existing backpack shoulder straps 14 and 16 and are secured thereto. The buckling elements on the front vest portions 74 and 76 are attached to the buckling elements 28 and 34 on the harness portion.

Figure 4:
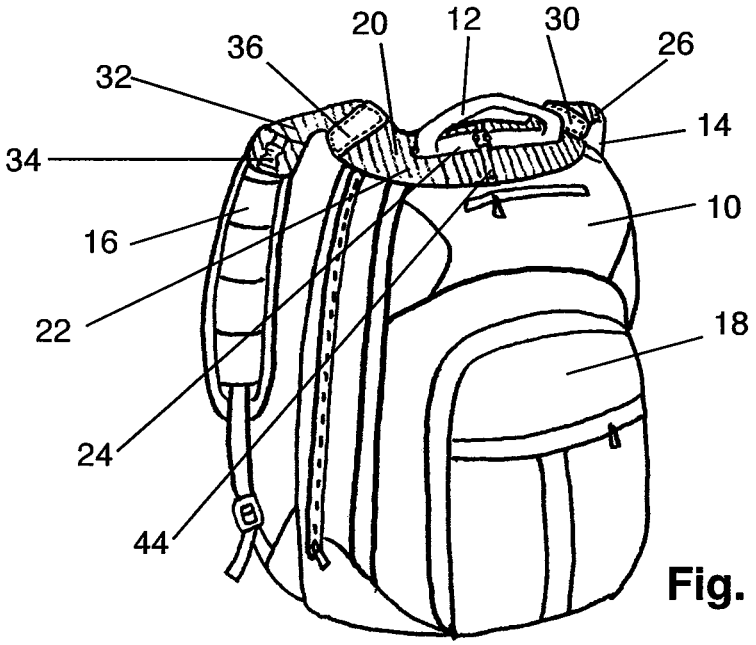
FIG. 4 is a perspective view of the harness portion of the present invention on an existing backpack.
Figure 5:
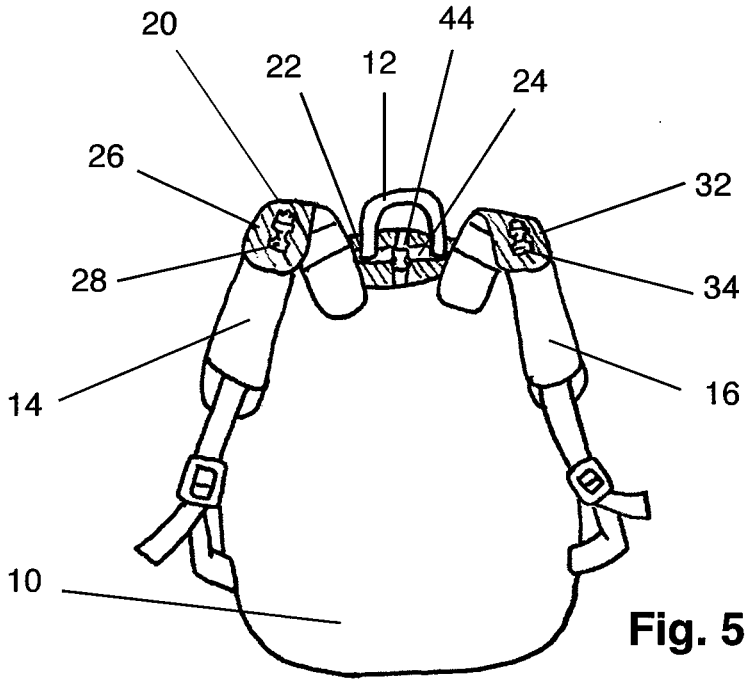
FIG. 5 is a front view of the harness portion of the present invention on an existing backpack.
Figure 6:
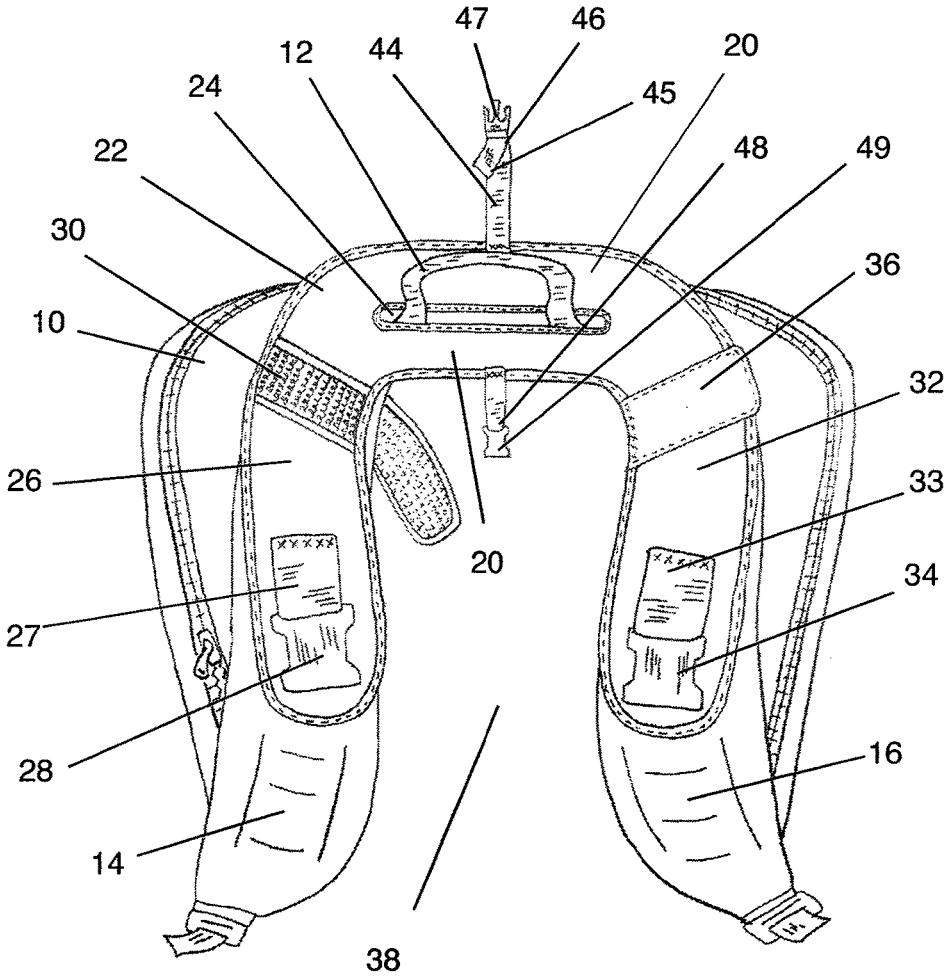
FIG. 6 is a front view of the harness portion of the present invention.
Figure 7:
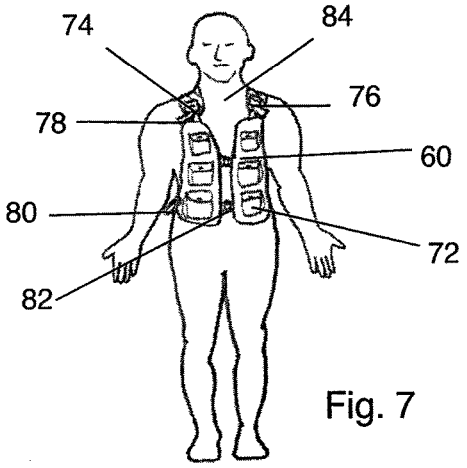
FIG. 7 is a front view of the frontal vest portion of the present invention on an existing backpack.
Figure 8:
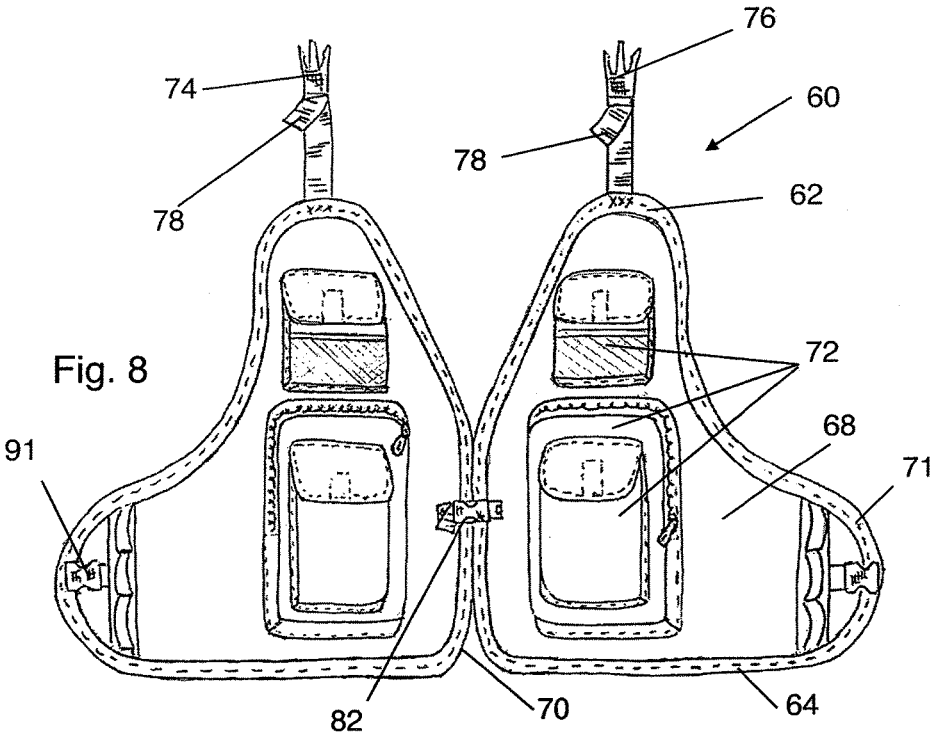
FIG. 8 is a front view of the frontal vest portion of the present invention.

As shown in FIGS. 4-6, the harness portion 20 further includes a securing loop band 30 and 36 on each harness shoulder strap 26 and 32. In the preferred embodiment, the securing loop bands 30 and 36 are constructed of hook-and-loop fasteners, such as VELCRO®, however other securing loops are contemplated such as, but not limited to, a side release buckle having an adjustable strap, a cam buckle having an adjustable strap, a snap/swivel hook with adjustable strap, a center release buckle with adjustable strap, an adjustable belt, or the like. There is a left securing loop band 36 and right securing loop band 30 on each harness portion 20. The securing loop bands 30 and 36 wrap around the existing backpack shoulder straps 14 and 16 and the corresponding harness shoulder straps 26 and 32. The securing loops 30 and 36 keep the shoulder harness straps 26 and 32 secured to the shoulder straps 14 and 16 on the existing backpack. The securing loop bands 30 and 36 allow for the use of the harness portion 20 and, as such, the modular vest system 1 in situations where an existing backpack 10 may not have a top handle 12. Furthermore, a top release band 44 is situated on the top element 22 of the harness portion 20. The top release band 44 is comprised of an adjustable strap 45 terminating in a male buckle 47 on the first end 46 and a female buckle 49 on the second end 48, each end is attached to the top element 22. The first and second ends 46 and 48 are perpendicular to the open slit 24 and top handle 12. The male side release buckle 47 on the first end 46 attaches to the female buckle 49 on the second end 48 and provides a securing means so as to keep the harness portion 20 from separating from the existing backpack 10. The adjustable strap 45 on the first end 46 accommodates backpacks 10 with differing locations or sizes of the top handle 12. Additionally, the opening slit 24 is sized to accommodate various sized top handles 12 on existing backpacks. The slit 24 includes a plastic or rubber edge, which over time provides strength, to maintain frictional contact with the top handle 12 on the existing backpack 10. The right harness shoulder strap 26 and left harness shoulder strap 32, which extend from opposing ends of the top element 22, are constructed of a webbing 27 and 33 which secure each receiving buckle element 28 and 34 on the harness 20. The webbing 27 and 33 allows for pivoting of the buckles 28 and 34 and, subsequently, also the vest portion 60 so that the vest portion 60 can be worn on the backside of the body or across the body, more aptly shown in FIG. 12. The harness portion 20 further includes a D-ring 42, which provides an attachment site for rear vertical adjustment straps 40, discussed later.

Figure 11:
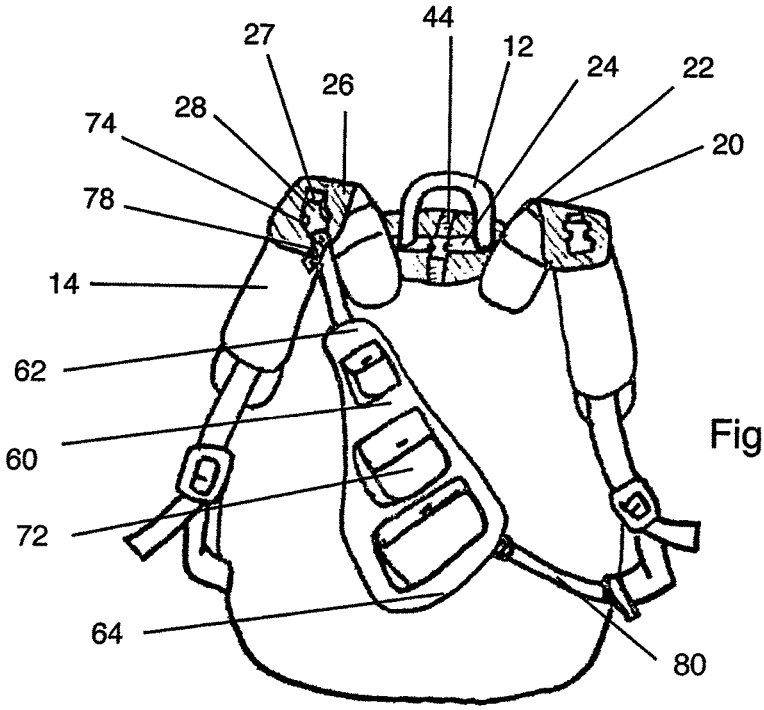
FIG. 11 is a front view of an alternative embodiment of the present invention.

As shown in FIGS. 7-10, the modular vest system 1 includes a pair of frontal vest portions 60; however it is contemplated that the modular vest system 1 may only use one vest portion 60 as shown in FIG. 11. The vest portion 60 is comprised of a top end 62, bottom end 64, interior surface 66 (shown in FIG. 10), exterior surface 68, an inside edge 70, outside edge 71, at least one pocket 72, and corresponding buckling elements 74 and 76. On the top end 62 of each frontal vest 60 is a corresponding buckling element 74 and 76 that correspond to the buckling elements 28 and 34 on the harness portion 20. The corresponding buckling elements 74 and 76 are attached to an adjustable strap 78 on the top end 62 of the vest portion 60. This allows for adjusting the height of the vest portion 60 depending on the wearer's body size. The pockets 72 are attached to the exterior surface 68 of the vest portion 60. The pockets 72 may vary in size and style depending on the intended use of the vest 1. Additionally, the exterior surface 68 and back end of the pocket 72 may be lined with hook-and-loop fasteners for ease in switching or removing pockets, not shown. On the inside edge 70 of each vest portion 60 is another adjustable buckle 82 allowing for each vest portion 60 to be secured at the midline of the body. This adjustable buckle 82 defines a neck opening 84 for the wearer. An adjustable waist belt 80 is also on the opposing outside edge 71. The adjustable waist belt 80 attaches about the waist of the wearer. One end of the waist belt is wrapped about the rear waist of the wearer and connected to the opposing cooperating buckle on the opposite outside edge 71. The waist belt 80 prevents the vest portions 60 from "flopping" as it secures the vest 1 tightly against the body of the wearer. Along the length of the waist belt that wraps about the rear waist to the opposite exterior edge is disposed a ring 86, see FIG. 12. The ring 86 allows for connection of a clip from the rear vertical attachment 40, discussed later.

Figure 3:
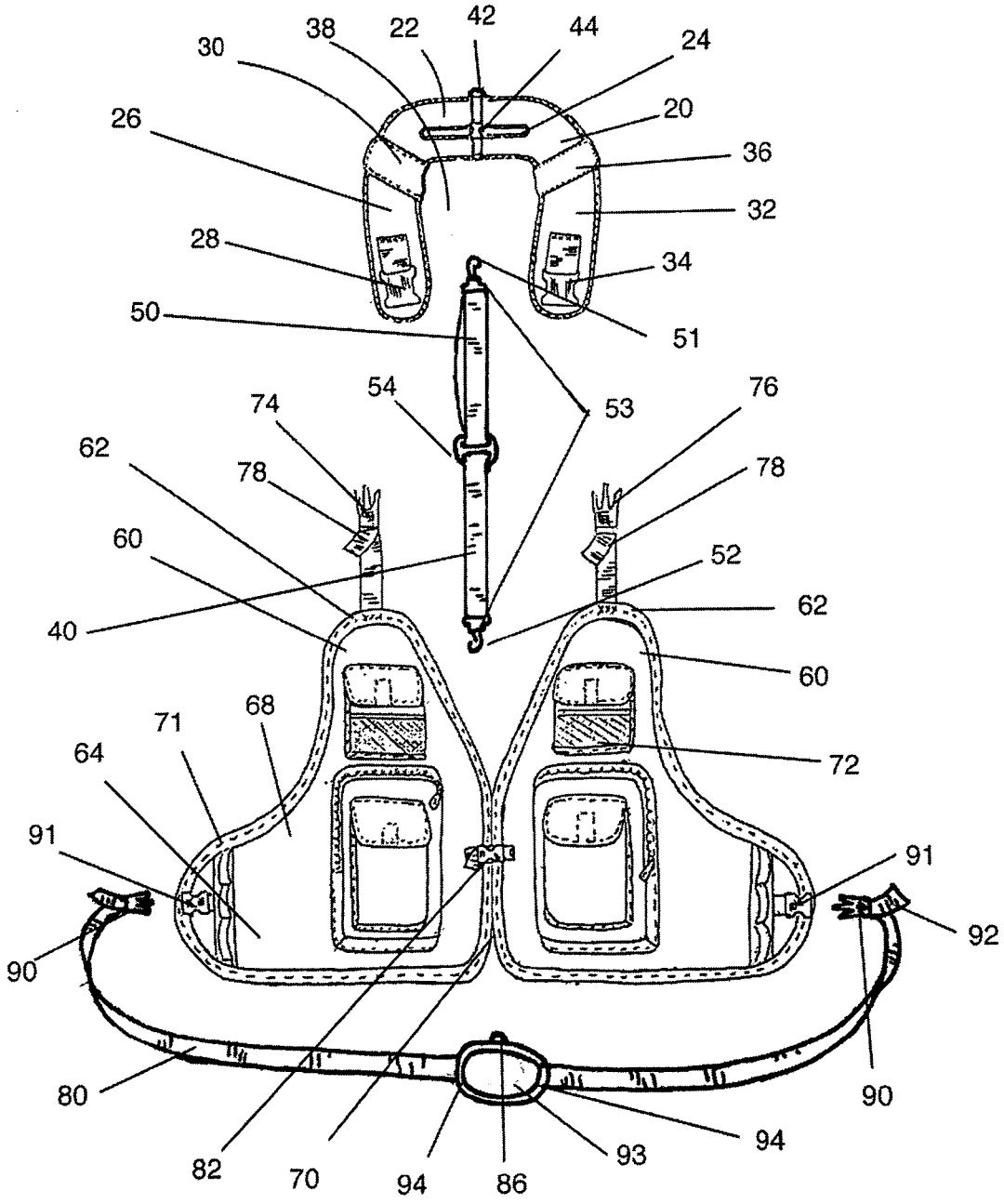
FIG. 3 is a front view of the present invention.
Figure 15:
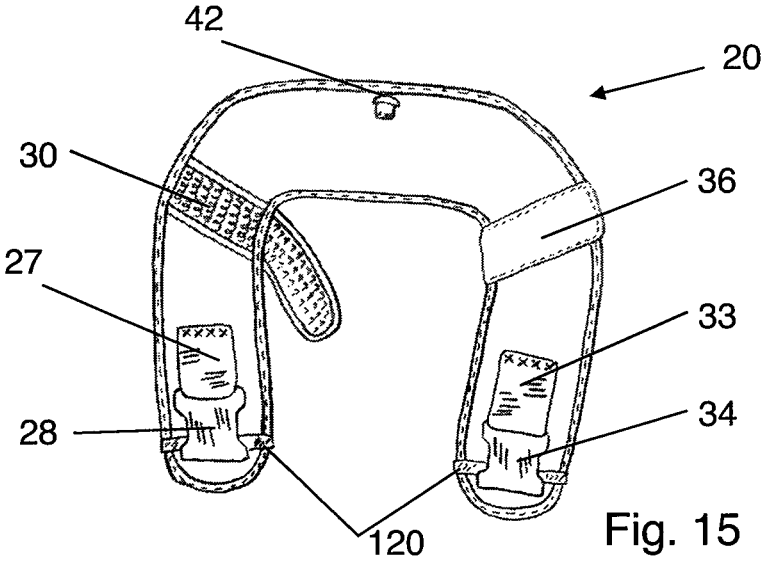
FIG. 15 is a front view of an alternative embodiment of the harness portion of the present invention.

As shown in FIG. 6, the attachment of the harness portion 20 to an existing backpack 10 shows the shoulder straps 14 and 16 on the existing backpack 10 being secured between the shoulder straps 26 and 32 on the harness 20 and the securing loop on the right and left sides, 30 and 36 respectively. The top handle 12 on the existing backpack 10 is pulled through the opening slit 24 on the top element 22 of the harness 20, and then top release band 44 is secured through and around the top handle 12 of the backpack 10. As shown in FIG. 3, the attachment of the vest portion 60 to the harness portion 20 is done with ease. The harness portion 20 rests primarily on top of the wearer's shoulder. The right shoulder strap 26 on the harness portion 20, having a buckling element 28, is connected to the right corresponding buckling element 74 on the vest portion 60 and similarly on the left side. The buckling elements on both the vest portion 60 and harness portion 20 attach in front of the user's body. Furthermore, as shown in FIG. 15, the harness portion 20 may also include a pair of secondary straps 120 that secure the lower end of the harness portion 20 to the shoulder straps 14 and 16 on the existing backpack 10. The secondary straps 120 are constructed of hook-and-loop fasteners.

As shown in FIGS. 9 and 10, the modular vest 1 need not be used in combination with an existing backpack. The modular vest 1 is contemplated for use by itself. It is contemplated that the top element 22 and shoulder straps 26 and 32 on the harness portion 20 are constructed from closed cell foam with double sided mesh 110. It is also contemplated the top end 62 of the frontal vest portions 60 are constructed from closed cell foam with double sided mesh 112.

Figure 12:
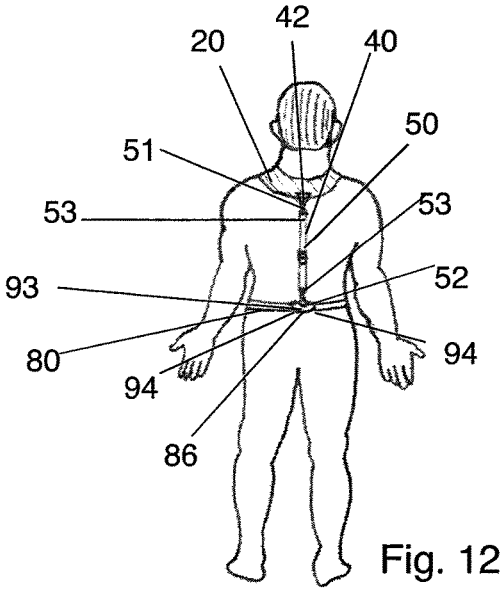
FIG. 12 is a back view of an alternative embodiment of the frontal vest portion of the present invention.
Figure 13:
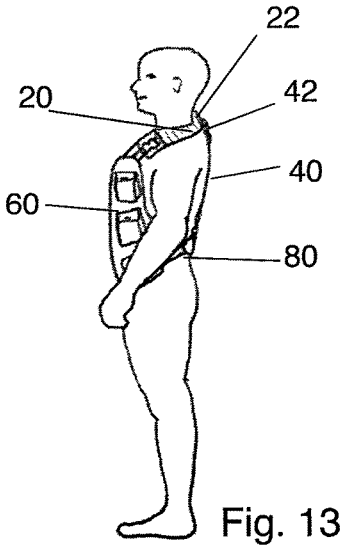
FIG. 13 is a side view of an alternative embodiment of the frontal vest portion of the present invention.

An additional securing means such as a rear vertical attachment 40 is contemplated, as shown in FIGS. 3 and 12, on the harness portion 20. The rear vertical attachment 40 is comprised of an elongated strap 50 including a first end 51 and second end 52, whereby each has a swivel latch hook 53, and thereinbetween the elongated strap 50 has a sliding tri-glide 54 to allow for the strap 50 to be adjusted to various lengths. The rear vertical adjustment (rear vertical attachment in first sentence) 40 attaches by the first end 51 to the D-ring 42 on harness portion 20 and on the second end 52 to a D-ring 86 disposed on the waist belt 80, as discussed later. The rear vertical adjustment strap 40 allows for the user to use the modular vest 1 without a backpack, as shown in FIGS. 12 and 13. The adjustable waist belt 80, shown in FIGS. 3 and 12, is comprised of an elongated adjustable belt 80 having a first end including a male buckle 90 and a second end including a female side release buckle 91 and adjustable clip 92, and thereinbetween a closed cell foam laminated pad 93 having an opening 94 on opposite ends thereof to allow for the waist belt 80 to move within. The foam pad 93 is to be placed against the wearer's back for comfort, and further includes a D-ring attachment site 86 for latching to the swivel latch hook 53 on the second end 52 of the rear vertical attachment 40.

Figure 14:
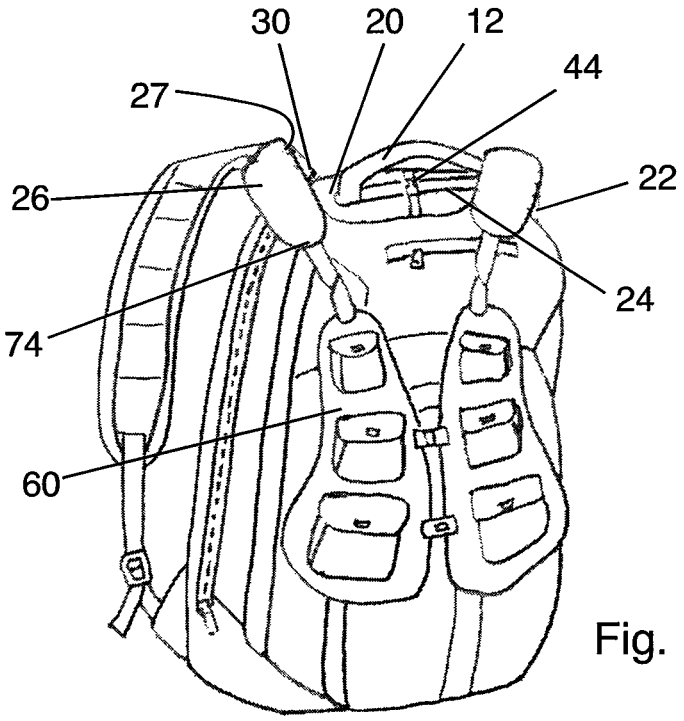
FIG. 14 is a perspective view of an alternative embodiment of the present invention.

Various alternative embodiments are contemplated for the modular vest 1. As shown in FIG. 11, the modular vest 1 need not use a pair of vest portions, but rather one left or one right vest portion 60. The top end 62 of the vest portion 60 is attached to the harness portion 20 and the bottom end 64 can be fitted with an auxiliary strap 110 for attachment of the shoulder strap on the existing backpack 10. In yet another embodiment, the harness portion 20 is provided with adjustable straps 26 and 32 connected to the buckles 28 and 34 on the opposite ends, as shown in FIG. 6. On the adjustable straps 26 and 32 are included a webbing 27 and 33 which allows for pivoting of the buckles 28 and 34 so that the vest portion 60, when attached thereto, can be worn on the backside of the body, as shown in FIG. 14.

Various securement and attachment means are contemplated for use in the instant invention. For instance, hook-and-loop fasteners are preferred in attaching the harness portion 20 to the existing shoulder straps 14 and 16; however, a side release buckle having an adjustable strap, a cam buckle having an adjustable strap, a snap/swivel hook with an adjustable strap, a center release buckle with an adjustable strap, an adjustable belt, or the like are also contemplated. Although the securement means are depicted in securing the shoulder strap on the harness portion to the shoulder strap on an existing backpack, it is contemplated these securement means can be used in securement as buckling elements, in securement of the harness portion to the vest portion, or similarly in securement of the waist or rear vertical attachments.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A modular utility vest system comprised of: a harness portion, said harness portion including a U-shaped top element having a pair of opposing ends, a top element shoulder strap extending from each opposing end of said top element and each said top element shoulder strap having at least one first buckling element, said harness portion constructed and arranged to be removably coupled to a pair of backpack shoulder straps, said top element in combination with each said backpack shoulder strap, forming a neck opening sized to accommodate a neck of a user, said harness portion including an open slit for removably coupling said harness portion with a top handle on a backpack; and at least one frontal vest portion, said at least one frontal vest portion being comprised of a top end and at least one pocket for storing articles, said top end of each said at least one frontal vest portion including a second buckling element; said second buckling element coupling to a respective first buckling element to secure said at least one frontal vest portion to a respective said top element shoulder strap so that said at least one frontal vest portion depends vertically and is supported by said top element, a bottom portion of each said at least one frontal vest portion including a third buckling element for attachment to a waist connector strap, said waist connector strap being adjustable in length to extend around a waist of said user and connect to said bottom portion of said at least one frontal vest portion to restrict movement of said bottom portion; whereby said modular utility vest system is constructed to be put on over a backpack, said harness portion positioned over said top handle of said backpack and wherein said pair of top element shoulder straps are configured to lay over a top surface of said pair of backpack shoulder straps when said at least one first buckling element is attached to a corresponding said second buckling element.

2. The modular utility vest system of claim 1, wherein said modular utility vest system is adjustable to various sizes to accommodate most wearers.

3. The modular utility vest system of claim 1, wherein said modular utility vest system is constructed of moisture resistant material so as to preclude the passage of moisture therethrough without prohibiting adequate airflow for ventilation.

4. The modular utility vest system of claim 1, wherein said adjustable buckling elements on said harness are fitted with quick-release type fasteners engageable with said second buckling elements on said frontal vest portion fitted with corresponding quick-release type fasteners.

5. The modular utility vest system of claim 1, wherein said frontal vest portion includes an interior lining provided with a cushioning pad for the comfort of the wearer.

6. The modular utility vest system of claim 1, wherein said at least one frontal vest portion includes a left frontal vest portion and a right frontal vest portion.

7. The modular utility vest system of claim 6, wherein said left and right frontal vest portions each include an interior edge having a corresponding connector on each said interior edge that enables the user to wear said frontal vest portions connected or separated from each other.

8. The modular utility vest system of claim 7, wherein said connector is a zipper.

9. The modular utility vest system of claim 7, wherein said connector is a quick-release type fastener.

10. The modular utility vest system of claim 1, wherein said left and right harness shoulder straps are constructed of a webbing which secures each said adjustable buckling element thereon, whereby said webbing allows for pivoting of each said adjustable buckling element on said frontal vest portion, whereby pivoting of each said adjustable buckling element allows a user to wear said frontal vest portion across the backside of the body or angled crossing the front of the user.

11. The modular utility vest system of claim 1, wherein said at least one frontal vest portion includes a double-sided mesh lining.

12. The modular utility vest system of claim 1, wherein said top element on said harness portion includes a double-sided mesh lining.

13. The modular utility vest system of claim 1, wherein each said shoulder strap includes at least one securing band.

14. The modular utility vest system of claim 13, wherein said at least one securing band is constructed of hook-and-loop fasteners.

* * * * *